US011988225B2

(12) United States Patent
Yamazaki

(10) Patent No.: US 11,988,225 B2
(45) Date of Patent: May 21, 2024

(54) AXIAL FAN

(71) Applicant: SANYO DENKI CO., LTD., Tokyo (JP)

(72) Inventor: Yoshihisa Yamazaki, Tokyo (JP)

(73) Assignee: SANYO DENKI CO., LTD., Tokyo (JP)

( * ) Notice: Subject to any disclaimer, the term of this patent is extended or adjusted under 35 U.S.C. 154(b) by 0 days.

(21) Appl. No.: 18/344,466

(22) Filed: Jun. 29, 2023

(65) Prior Publication Data

US 2024/0026898 A1 Jan. 25, 2024

(30) Foreign Application Priority Data

Jul. 25, 2022 (JP) ..... 2022-117872

(51) Int. Cl.
*F04D 19/00* (2006.01)
*F04D 29/38* (2006.01)

(52) U.S. Cl.
CPC ..... *F04D 29/386* (2013.01); *F04D 19/002* (2013.01)

(58) Field of Classification Search
CPC ..... F04D 19/002; F04D 29/386
See application file for complete search history.

(56) References Cited

U.S. PATENT DOCUMENTS 5,297,931 A * 3/1994 Yapp ..... F04D 29/164 416/223 R
5,582,507 A * 12/1996 Alizadeh ..... F04D 29/329 416/169 R
6,554,574 B1 * 4/2003 Spaggiari ..... F04D 29/384 416/243
6,558,123 B1 * 5/2003 Spaggiari ..... F04D 29/384 416/243
7,422,420 B2 * 9/2008 Spaggiari ..... F04D 29/386 416/DIG. 2
2008/0101964 A1 5/2008 Iwase et al.
2010/0158677 A1 6/2010 Ishihara
2020/0240430 A1 * 7/2020 Arai ..... F04D 29/384
2020/0370562 A1 * 11/2020 Lee ..... F04D 29/384

FOREIGN PATENT DOCUMENTS

JP 4943817 B2 5/2012
JP 5210852 B2 6/2013

* cited by examiner

*Primary Examiner* — Long T Tran
(74) *Attorney, Agent, or Firm* — RANKIN, HILL & CLARK LLP

(57) ABSTRACT

Provided is an axial fan including multiple forward-swept blades. An angle of advance of a trailing edge of the forward-swept blade is larger than an angle of advance of a leading edge of the forward-swept blade. An outer portion of the trailing edge, being positioned further in an outer periphery of the trailing edge than an intermediate portion of the trailing edge with respect to a rotary shaft of the axial fan, advances as the trailing edge advances radially outward of a ventilation channel of the axial fan.

6 Claims, 13 Drawing Sheets

AXIAL FAN

CROSS-REFERENCE TO RELATED APPLICATION

This application is based on Japanese Patent Application No. 2022-117872 filed with the Japan Patent Office on Jul. 25, 2022, the entire content of which is hereby incorporated by reference.

BACKGROUND

1. Technical Field

The present disclosure relates to an axial fan.

2. Related Art

Fans are known that are used, for example, in industrial air-conditioning apparatuses or medical devices. Such apparatuses or devices are installed in an environment where people are present near the apparatuses or devices in some cases. Thus, the fans used in the apparatuses or devices are required to be low-noise. An axial fan disclosed in Japanese Patent No. 4943817 generates an air flow parallel to its rotary shaft in a plane containing the rotary shaft while maintaining static pressure, to achieve a reduction in noise. Another axial fan disclosed in Japanese Patent No. 5210852 can decrease a drop at the inflection point appearing in the graph of the characteristics of air volume versus static pressure and reduce the noise.

The axial fan in Japanese Patent No. 4943817 includes an impeller with a hub and multiple blades disposed around the hub. A line connecting the intersection between the trailing edge of each blade and the blade tip, to the center of rotation of the impeller is positioned further in the rotational direction than the line connecting the intersection between the leading edge of the blade and the boundary between the hub and the blade, to the center of rotation of the impeller. The warpage of the blade protruding toward an air inlet centrifugally increases gradually. The exit angle of the blade gradually increases in a section starting from the radius of the position where the exit angle of the blade has a minimum value between the radius of the hub and the radius of blade tip and ending at the radius of the blade tip. This can generate an air flow parallel to the rotary shaft to achieve a reduction in noise.

The axial blower in Japanese Patent No. 5210852 includes roots fixed to the peripheral wall of a hub and reverse flections extending along tips of blades in regions near the tips of the blades radially facing each other. The reverse flection is raised in the rotational direction and recessed in the direction opposite to the rotational direction. The reverse flection extends along the tip from the trailing end of the radially extending blade, where one end of the root of the blade is positioned, to the vicinity of the leading end of the radially extending blade, where the other end of the root of the blade is positioned. This gradually reduces the radial width of the reverse flection and the depth of the recess formed in the reverse flection from the trailing edge of the blade to the leading edge of the blade. A reduction in noise is thereby achieved.

In this manner, multiple proposals have been made that modify the shape of the blade to reduce the noise. The axial fan of Japanese Patent No. 4943817 and the axial blower of Japanese Patent No. 5210852, however, cannot necessarily sufficiently reduce the noise. In other words, the axial fans still have room for improvement.

In view of the above, an object of the present disclosure is to provide an axial fan capable of reducing generation of noise.

SUMMARY

An axial fan according to an embodiment of the present disclosure includes multiple forward-swept blades. An angle of advance of a trailing edge of the forward-swept blade is larger than an angle of advance of a leading edge of the forward-swept blade. An outer portion of the trailing edge, being positioned further in an outer periphery of the trailing edge than an intermediate portion of the trailing edge with respect to a rotary shaft of the axial fan, advances as the trailing edge advances radially outward of a ventilation channel of the axial fan.

DETAILED DESCRIPTION

Figure 1:
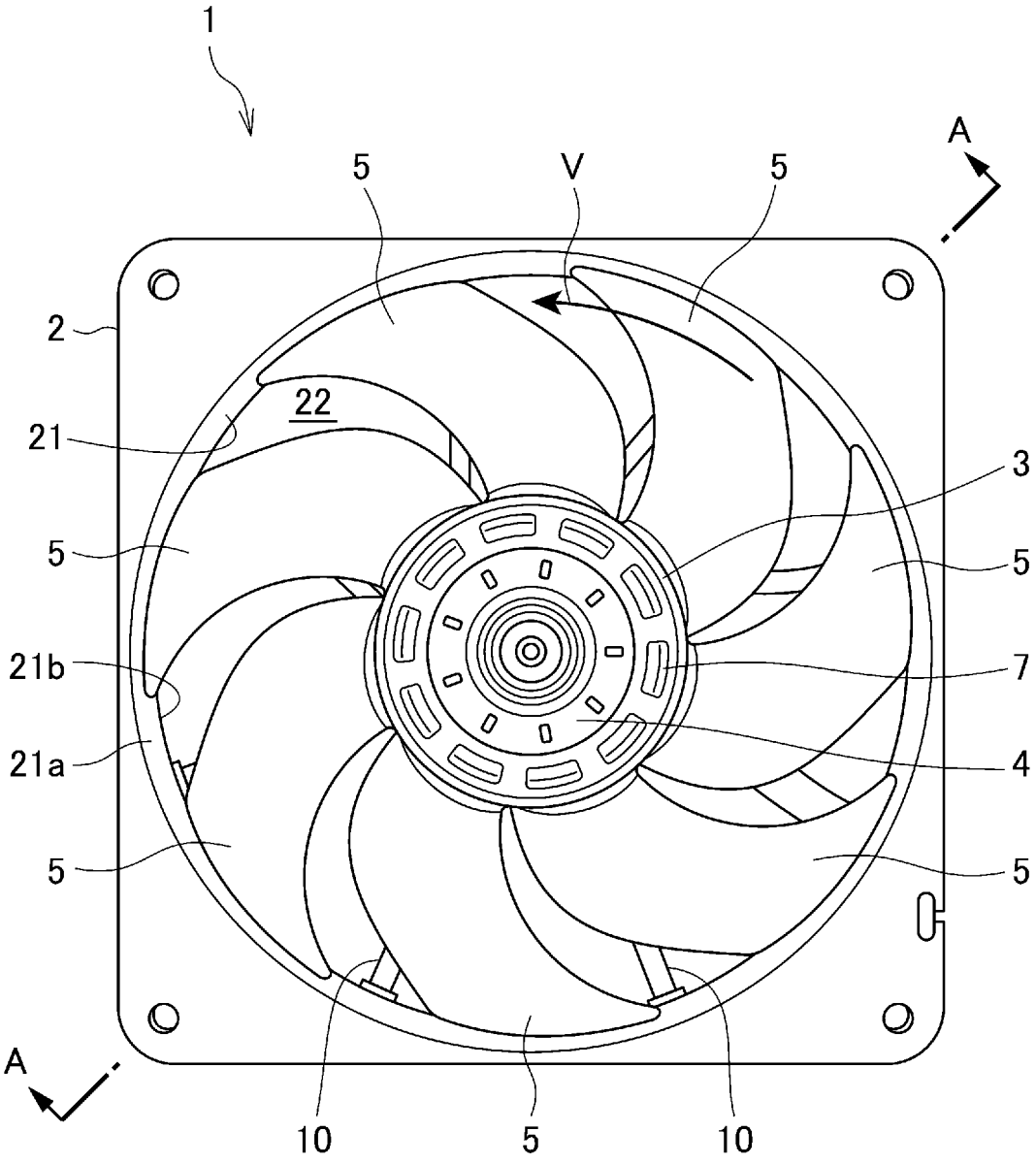
FIG. 1 is a front view of an axial fan according to an embodiment of the present disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

An axial fan according to one aspect of the present disclosure includes multiple forward-swept blades. An angle of advance of a trailing edge of the forward-swept blade is larger than an angle of advance of a leading edge of the forward-swept blade. An outer portion of the trailing edge, being positioned further in an outer periphery of the trailing edge than an intermediate portion of the trailing edge, is shaped to advance as the trailing edge advances radially outward.

The present embodiment can provide an axial fan capable of reducing generation of noise.

Embodiments of the present disclosure will now be described with reference to the accompanying drawings. For the sake of convenience in description of the embodiments, explanation of a component(s) is omitted that have the same reference numerals as those that have been already described. For the sake of convenience in description, the components illustrated in the drawings may have different sizes from the actual components.

FIG. 1 is a front view of one exemplary axial fan according to an embodiment of the present disclosure. As illustrated in FIG. 1, an axial fan 1 includes a casing 2, an impeller 3 disposed in the casing 2, and a motor 7 for rotatingly driving the impeller 3. The impeller 3 includes an impeller cup (hub) 4 and multiple blades 5 (seven blades in the present embodiment) mounted on the impeller cup 4. The motor 7 is accommodated in the impeller cup 4.

The entirety of the casing 2 is substantially rectangular in shape. The casing 2 includes a cylindrical frame 21 surrounding the outer periphery of the blade 5. The frame 21 has an intake port 21*a* (an opening in the top of the frame in the figure) for breathing air and an exhaust port 21*b* for exhausting the air (an opening in the bottom of the frame). The frame 21 defines a ventilation channel 22 communicated with the intake port 21*a* and the exhaust port 21*b*. Rotation of the blades 5 blows the air breathed from the intake port 21*a* in a direction along the ventilation channel 22 (hereinafter referred to as "air blowing direction W") for exhaust from the exhaust port 21*b* to the exterior. The direction of an arrow V illustrated in the figure indicates the rotational direction of the blades 5.

Figure 2:
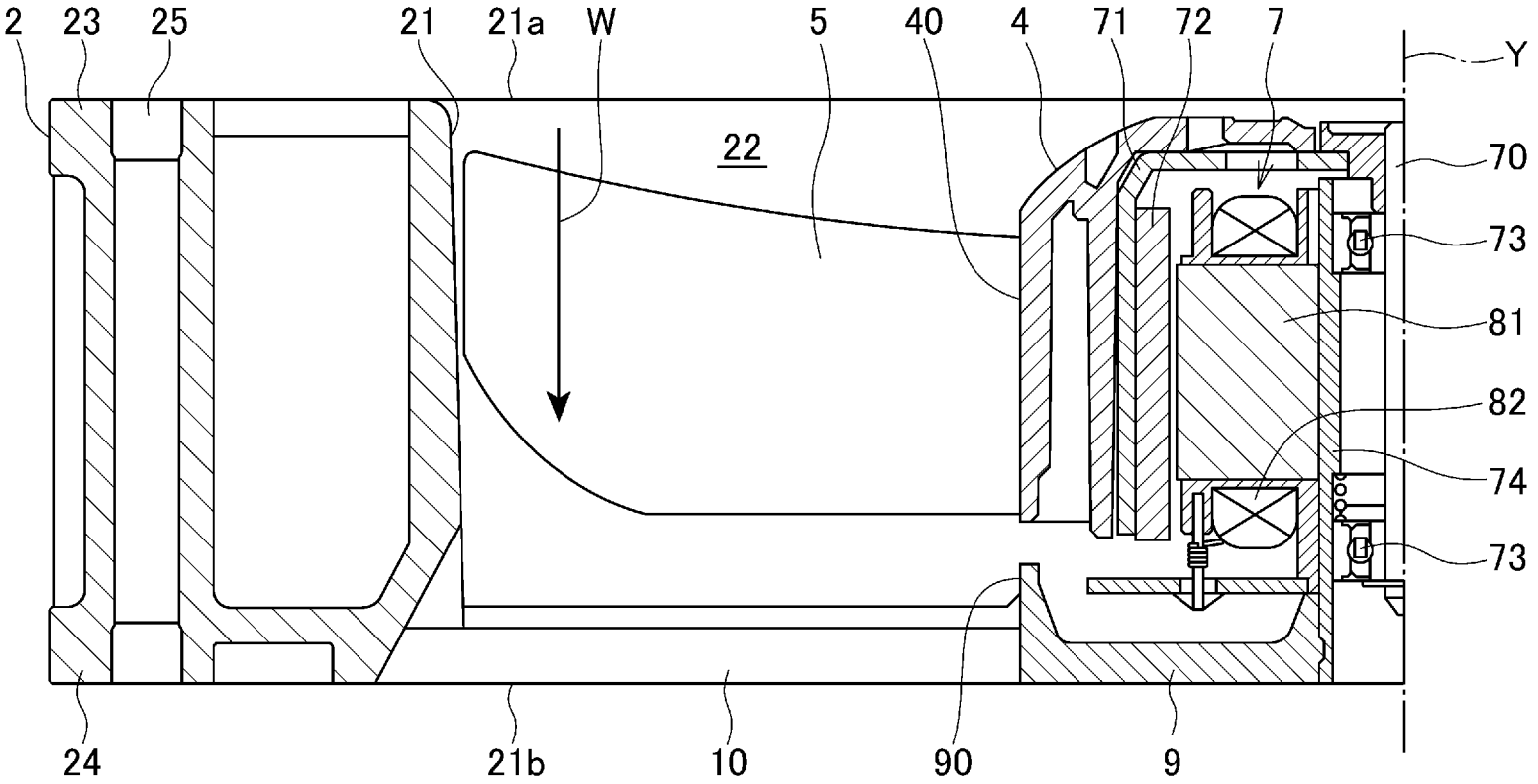
FIG. 2 is a half sectional view of the axial fan illustrated in FIG. 1, taken along line A-A.

FIG. 2 is a half sectional view of the axial fan 1 illustrated in FIG. 1, taken along line A-A. As illustrated in FIG. 2, the impeller cup 4 is fixed on a rotary shaft 70 of the motor 7. The rotary shaft 70 is disposed in a central portion of the ventilation channel 22 along the ventilation channel 22. The rotary shaft 70 is disposed such that its axis Y is in the air blowing direction W. The impeller cup 4 is fixed on the rotary shaft 70 along the ventilation channel 22 such that an opening of the cup points in the direction of the exhaust port 21*b* of the ventilation channel 22. An outer peripheral side face 40 that is outward in the radial direction (hereinafter simply referred to as "radially") around the rotary shaft 70 under the impeller cup 4 forms an inner circumference on a side of the intake port 21*a* of the ventilation channel 22. The outer peripheral side face 40 of the impeller cup 4 is formed so as to extend in parallel to the air blowing direction W. The impeller cup 4, on which the blades 5 are mounted, rotates together with the rotary shaft 70 in the ventilation channel 22. This blows the air in the air blowing direction W.

The blades 5 are integrated with the impeller cup 4 and radially mounted on the periphery of the impeller cup 4. The blades 5 are disposed so as to slope relative to the rotary shaft 70.

The motor 7 is a device for rotatingly driving the blades 5 and is accommodated in the impeller cup 4. The motor 7 includes a substantially cup-shaped rotor yoke 71, the rotary shaft 70 pressed in a central portion of the rotor yoke 71, and a stator core 81 with a wound coil 82.

The rotor yoke 71 is fitted in the impeller cup 4. The rotor yoke 71 rotates together with the rotary shaft 70. On an inner face of the rotor yoke 71, a magnet 72 is mounted. The rotary shaft 70 is rotatably supported by bearings 73. The bearings 73 are fixed on an inner face of a tubular support 74. On an outer face of the support 74, the stator core 81 is fixed. The outer face of the stator core 81 faces an inner face of the magnet 72 on the rotor yoke 71 with a gap therebetween.

The stator core 81 is mounted on a base 9. The base 9 is substantially cup-shaped. The base 9 is disposed on a side of the exhaust port 21*b* of the ventilation channel 22 such that a side of an opening of the base 9 faces a side of an opening of the impeller cup 4. The base 9 is disposed in the central portion of the ventilation channel 22 to be coaxial with the ventilation channel 22. A central portion of the base 9 is fixed on the outer face of the support 74. The outer peripheral side face 90 of the base 9, which is radially outward, forms an inner circumference on the side of the exhaust port 21*b* of the ventilation channel 22.

Peripheral edges at the intake port 21*a* and the exhaust port 21*b* in the frame 21 of the casing 2 are provided with flanges 23 and 24, respectively, for fixing the casing 2, for example, to an electronic apparatus. The flanges 23 run radially outward from the intake port 21*a* to the exterior of the casing 2. The flanges 24 run radially outward from the exhaust port 21*b* to the exterior of the casing 2. The flanges 23 and 24 each have a fixing hole 25 passing through the casing 2. The fixing hole 25 enables mounting of the axial fan 1 to, for example, an electronic apparatus by insertion of a screw.

On the side of the exhaust port 21*b* of the casing 2, multiple spokes 10 are disposed that couples the base 9 with the frame 21. The spokes 10 are disposed at the circumference of the base 9 at substantially equal intervals. The spokes 10 support the base 9 with the motor 7 mounted thereto.

Figure 3:
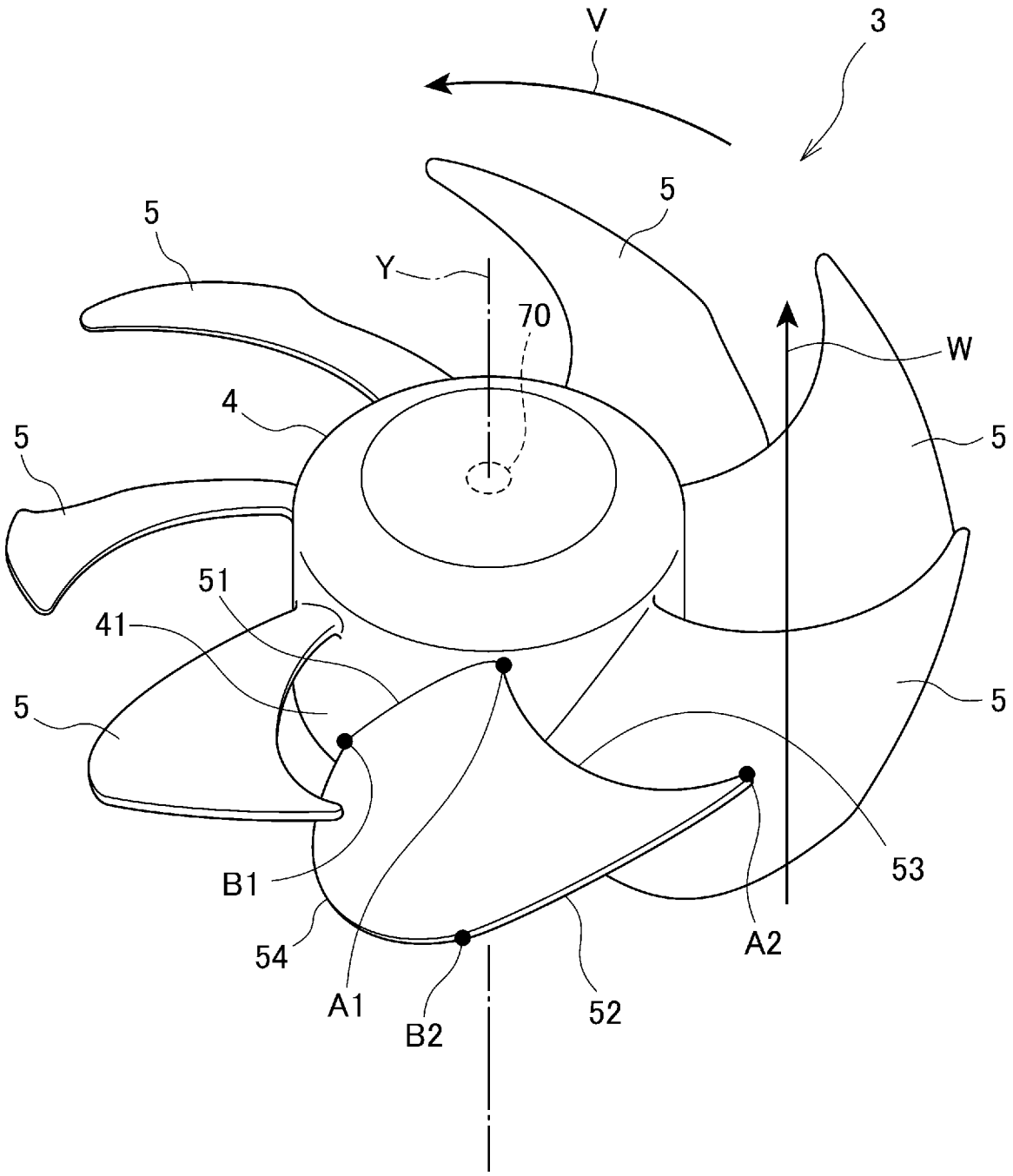
FIG. 3 is a perspective front view of an impeller of the axial fan illustrated in FIG. 1.

FIG. 3 is a perspective front view of the impeller 3. As illustrated in FIG. 3, the blade 5 of the impeller 3 is, at a radially inward blade root 51, coupled with a peripheral wall 41 of the impeller cup 4. The blade 5 is coupled with the peripheral wall 41 such that the blade root 51 slopes relative to the rotary shaft 70. In other words, the blade 5 is mounted on the impeller cup 4 such that an end B1 at the blade root 51 is positioned on a side of an opening of the peripheral wall 41 of the impeller cup 4. The blade 5 is mounted such that an end A1, on the opposite side of the end B1, is positioned on a side of a bottom portion that is located further in a rotational direction V than the end B1 and opposite to the side of the opening of the impeller cup 4. The blade 5 is mounted such that an outer peripheral edge 52, positioned radially outward of the blade 5 and on an opposite side of the blade root 51, slopes relative to the rotary shaft 70 like the blade root 51. In other words, the blade 5 is mounted such that an end B2 at the outer peripheral edge 52 is positioned on the side of the opening of the impeller cup 4 and such that an end A2, on the opposite side of the end B2, is positioned on a side of a bottom portion that is located further in the rotational direction V than the end B2 and opposite to the side of the opening of the impeller cup 4.

In the following description, the end B1 at the blade root 51 is referred to as "inner end B1 at a trailing edge" of the blade 5 and the end A1 at the blade root 51 as "inner end A1 at a leading edge" of the blade 5. The end B2 at the outer peripheral edge 52 is referred to as "outer end B2 at the trailing edge" of the blade 5 and the end A2 at the outer peripheral edge 52 as "outer end A2 at the leading edge" of the blade 5. Of the edge, being further in the rotational direction V, of the blade 5, a portion from the inner end A1 at the leading edge of the blade 5 to the outer end A2 at the leading edge of the blade 5 is referred to as "leading edge 53" of the blade 5. Of the edge, being behind in the rotational direction V, of the blade 5, a portion from the inner end B1 at the trailing edge of the blade 5 to the outer end B2 at the trailing edge of the blade 5 is referred to as "trailing edge 54" of the blade 5. The trailing edge 54 faces the leading edge 53. The aforementioned outer peripheral edge 52 extends from the outer end A2 at the leading edge to the outer end B2 at the trailing edge.

Figure 4:
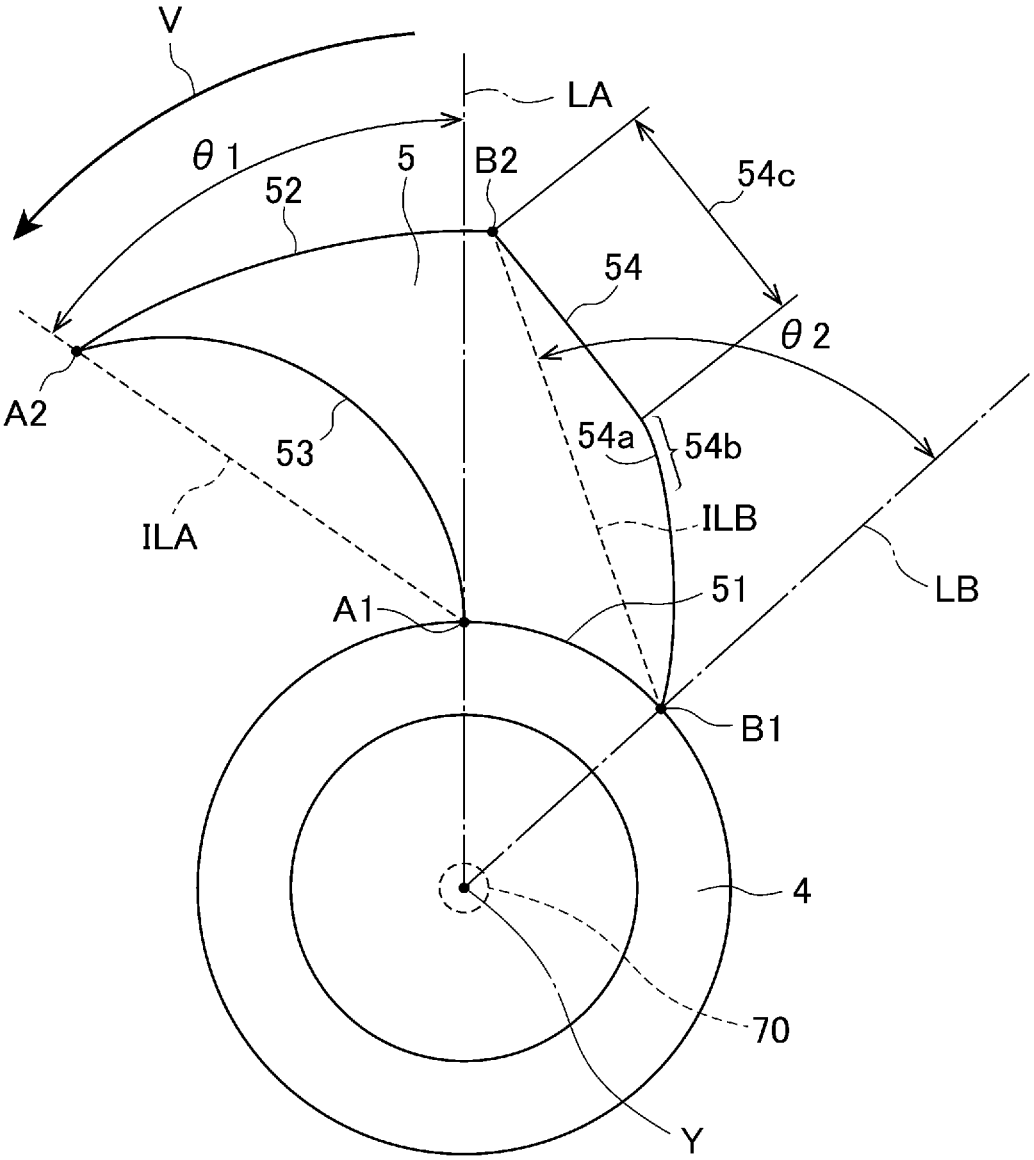
FIG. 4 is a front view of one blade mounted to the impeller cup.

FIG. 4 is a front view of a single blade 5 mounted to the impeller cup 4. As illustrated in FIG. 4, a line that passes through the axis Y of the rotary shaft 70 and the inner end A1 at the leading edge of the blade 5 is defined as a central line LA at the leading edge, and the outer end A2 at the leading edge of the blade 5 is positioned further in the rotational direction V than the central line LA at the leading edge. A line that is orthogonal to the axis Y of the rotary shaft 70 and passes through the inner end B1 at the trailing edge of the blade 5 is defined as a central line LB at the trailing edge, and the outer end B2 at the trailing edge of the blade 5 is positioned further in the rotational direction V than the central line LB at the trailing edge. In this manner, the blade 5 of the axial fan 1 is of a "forward-swept" type having a structure where the outer end A2 at the leading edge and the outer end B2 at the trailing edge are both positioned further in the rotational direction V than the central lines LA and LB, respectively, passing through the inner ends at the edge of the blade 5.

A line passing through the inner end A1 at the leading edge of the blade 5 and the outer end A2 at the leading edge of the blade 5 is defined as an imaginary line ILA from the leading edge. In this case, an angle made by the central line LA at the leading edge and the imaginary line ILA from the leading edge is defined as an angle of advance θ1 of the leading edge. A line running through the inner end B1 at the trailing edge of the blade 5 and the outer end B2 at the trailing edge of the blade 5 is defined as an imaginary line ILB at the trailing edge. In this case, an angle made by the central line LB at the trailing edge and the imaginary line ILB at the trailing edge is defined as an angle of advance θ2 of the trailing edge. The blade 5 of the axial fan 1 is configured such that the angle of advance θ2 of the trailing edge is larger than the angle of advance θ1 of the leading edge. The blade 5 is also configured such that the outer end B2 at the trailing edge 54 is positioned behind the central line LA at the leading edge in the rotational direction V.

The trailing edge 54 of the blade 5 is shaped so as to advance in the rotational direction V of the blade 5 as an outer portion 54*c* of the trailing edge, which is positioned further in the outer periphery than an intermediate portion 54*b* of the trailing edge 54, travels radially outward. In other words, the trailing edge 54 is shaped so as to advance in the rotational direction V of the blade 5 as the outer portion 54*c* of the trailing edge, extending from the intermediate portion 54*b* to the outer end B2 at the trailing edge, approaches the position of the outer end B2 at the trailing edge. In this manner, the trailing edge 54 positioned further in the outer periphery than the intermediate portion 54*b* has a slope. As the slope advances radially outward, the ratio of advance of the blade 5 in the rotational direction V increases. In this context, a position that is radially at 50% of the blade 5, in other words, a position that is at 50% of the length of the trailing edge 54 from the inner end B1 at the trailing edge to the outer end B2 at the trailing edge is defined as a midpoint 54*a*. In this case, the position of the intermediate portion 54*b* of the trailing edge 54 refers to a position that is radially at 40 to 60% of the blade 5. The rest of the six blades 5 have the same configuration as the blade 5 described above. Thus, the description thereof is omitted.

Figure 5:
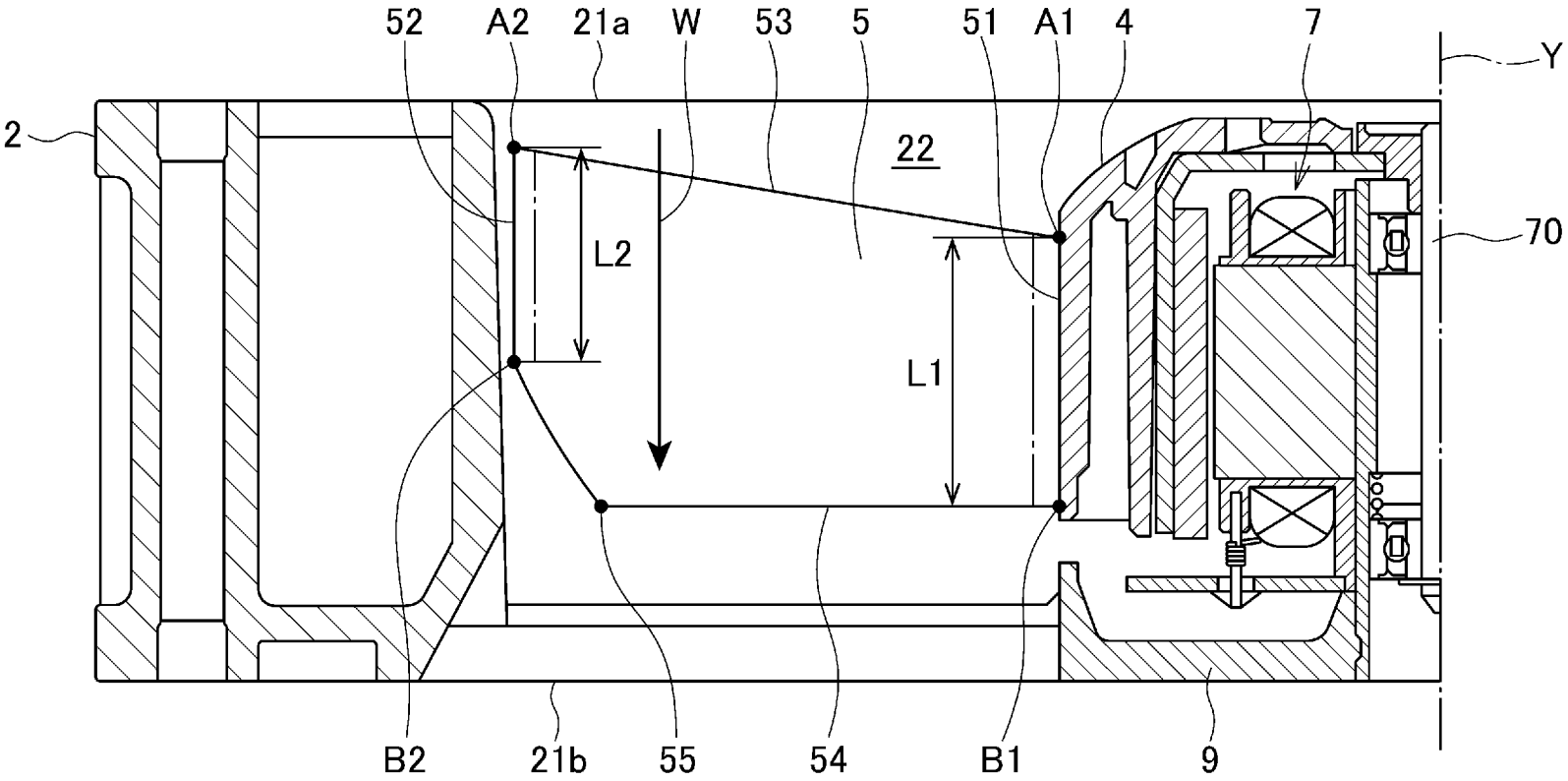
FIG. 5 is a half sectional view explaining a trailing edge and an outer peripheral edge of the blade.

FIG. 5 is a half sectional view illustrating features of the trailing edge 54 and the outer peripheral edge 52 of the blade 5. As illustrated in FIG. 5, the trailing edge 54 of the blade 5 has an inflection point 55 radially positioned at 60 to 90% of the blade 5. In other words, the blade 5 has the inflection point 55 positioned at 60 to 90% of the length of the trailing edge 54 from the inner end B1 at the trailing edge to the outer end B2 at the trailing edge. The inflection point 55 redirects extension of the trailing edge 54 from the radial direction of the blade 5 to the air blowing direction W. The blade 5 is configured such that a peripheral length L2 of the outer peripheral edge 52 in the air blowing direction W is shorter than a root length L1 of the blade root 51 in the air blowing direction W.

Figure 6:
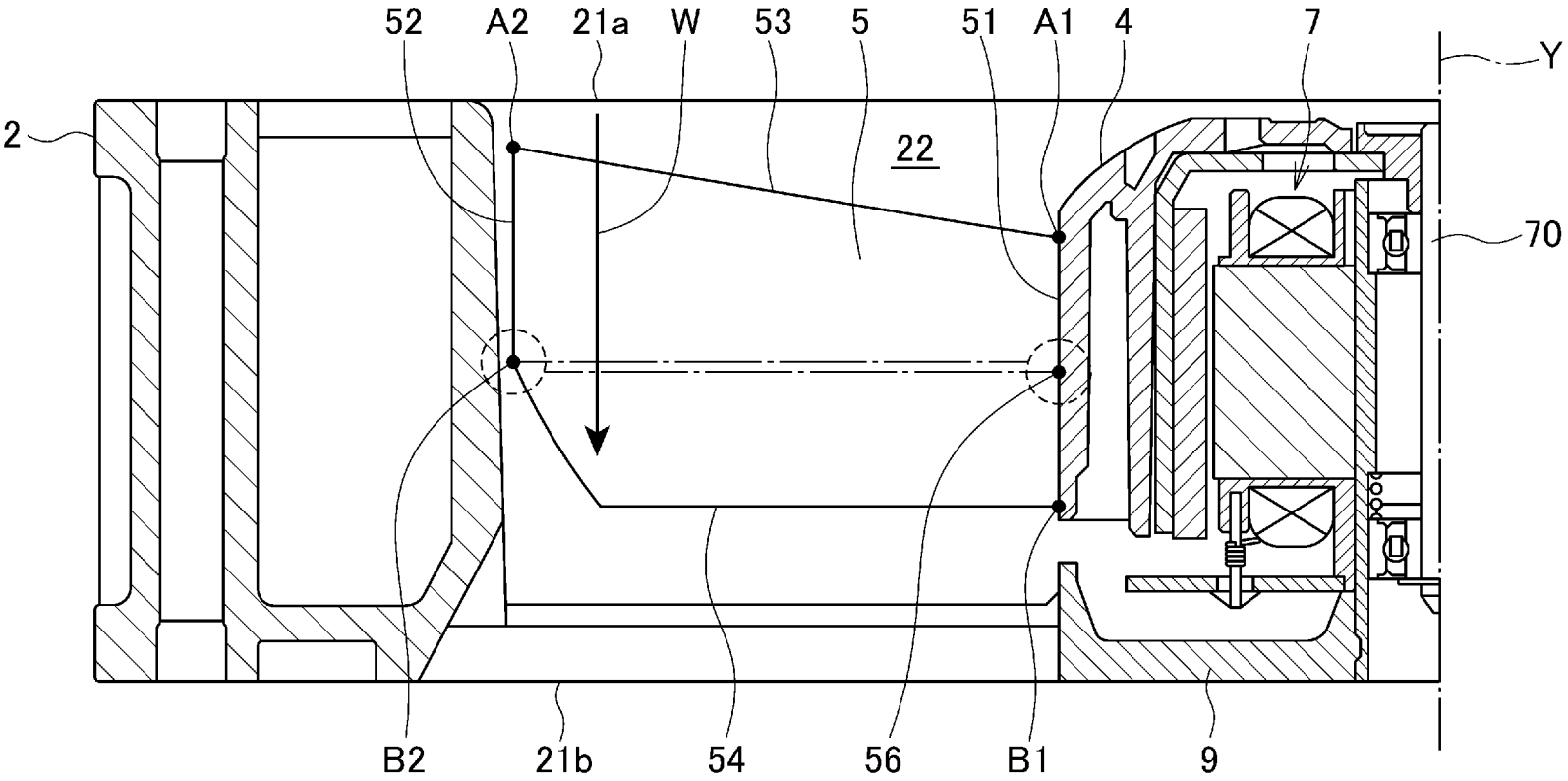
FIG. 6 is a half sectional view explaining an outer end at the trailing edge.

FIG. 6 is a half sectional view of features of the outer end B2 at the trailing edge 54 of the blade 5. As illustrated in FIG. 6, the outer end B2 at the trailing edge 54 of the blade 5 is positioned upstream of a midpoint 56 along the root length L1 of the blade root 51 in the air blowing direction W.

Figure 7:
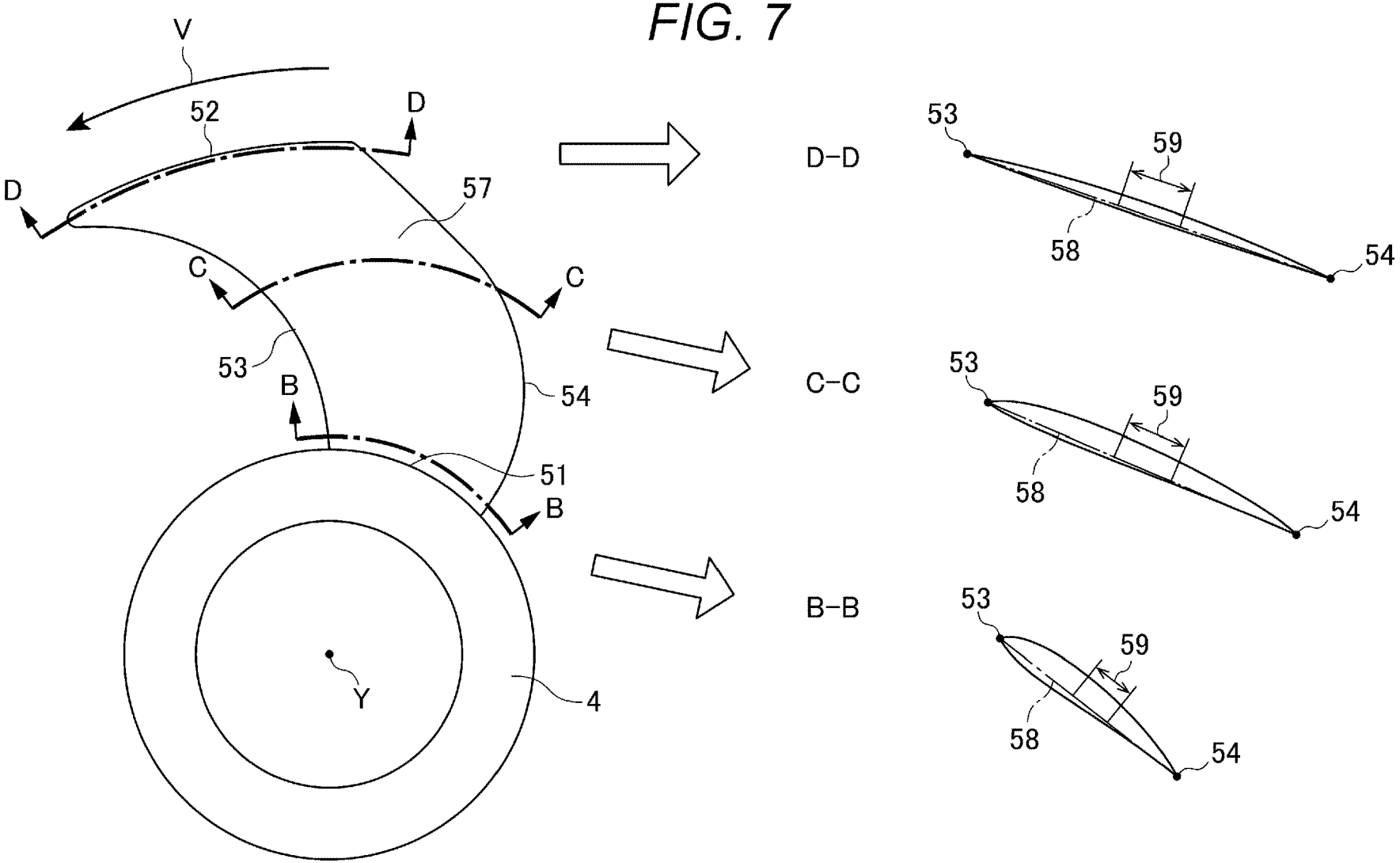
FIG. 7 is a sectional view explaining a camber of the blade.

FIG. 7 explains features of a camber of the blade 5. Specifically, FIG. 7 illustrates a sectional view of the blade root 51 of the blade 5 taken along line B-B in the rotational direction V, a sectional view of a radial central portion 57 of the blade 5 taken along line C-C in the rotational direction V, and a sectional view of the outer peripheral edge 52 of the blade 5 taken along line D-D in the rotational direction V. As illustrated in FIG. 7, a length of a chord line 58 connecting the trailing edge 54 and the leading edge 53 of the blade 5 is defined as the chord length, in each of the cross-sections taken along lines B-B, C-C, and D-D. In the cross-section, the largest camber is positioned in a section 59 at 40 to 60% of the chord length from the trailing edge 54. The largest camber decreases from the blade root 51 of the blade 5 through the radial central portion 57 of the blade 5 toward the outer peripheral edge 52 of the blade 5, i.e., radially from the interior toward the exterior of the blade 5. A decrease in camber of the blade 5 in the outer periphery can reduce wind pressure on the outer periphery. This can reduce a difference in wind pressure on the whole blade and thus restrain fluctuations in pressure.

Figure 8:
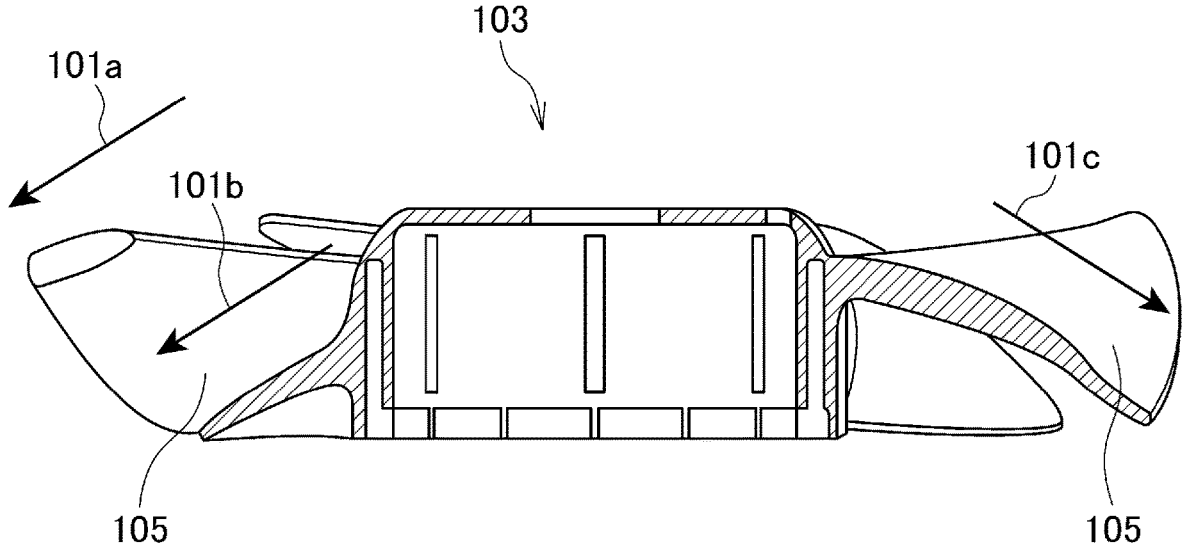
FIG. 8 explains the air flow in a common axial fan including forward-swept blades.
Figure 9:
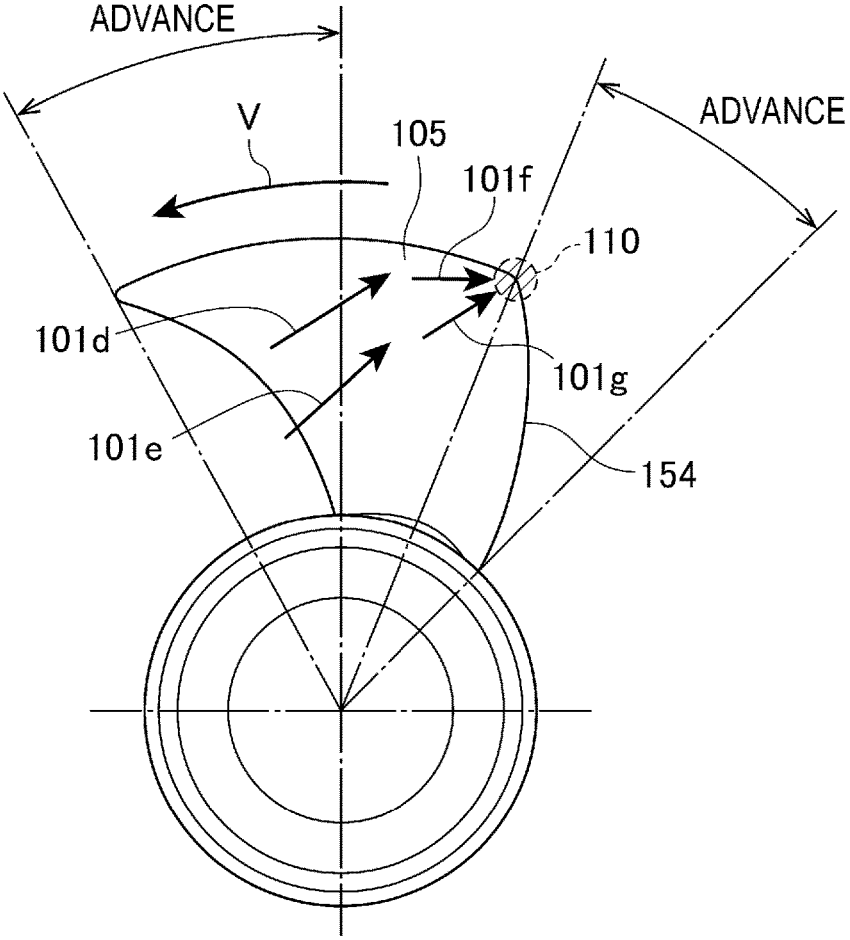
FIG. 9 explains the air flow in the common axial fan including the forward-swept blades.

Incidentally, the blade can be of a forward-swept type to achieve the silencing effect of the axial fan. The shape of the forward-swept blade, however, may cause generation of noise. FIG. 8 is a side view of one exemplary impeller. FIG. 9 is a top view of the exemplary impeller. These side and top views explain an air flow to a common axial fan including forward-swept blades. The air flow around the forward-swept blades is susceptible to centrifugal force generated by rotation of the blades. Thus, for example, the air to a blade 105 of an impeller 103 illustrated in FIGS. 8 and 9 flows to the outer periphery of the blade 105, as indicated by an arrow 101*a*, 101*b*, or 101*c*. The air flow to the outer periphery concentrates at, for example, an outer end 110 at a trailing edge 154 of the blade 105. Thus, the air flow disturbed by the increased pressure causes an increase in noise.

Figure 10:
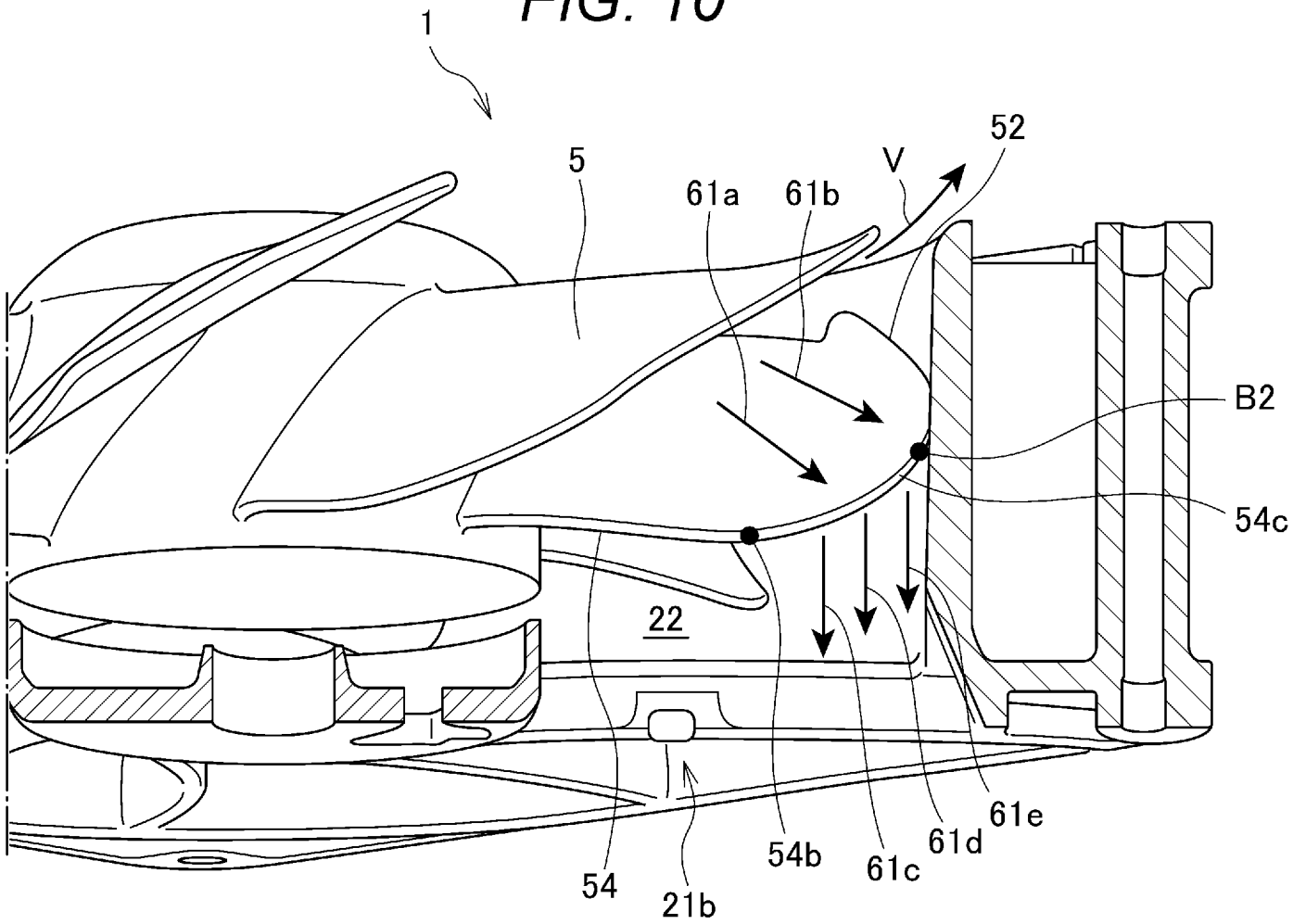
FIG. 10 explains the air flow in the axial fan according to the embodiment of the disclosure.

In contrast, in the axial fan 1 according to the present embodiment, the angle of advance θ2 of the trailing edge 54 is larger than the angle of advance θ1 of the leading edge 53. The outer portion 54*c* of the trailing edge is positioned further in the outer periphery than the intermediate portion 54*b* of the trailing edge 54. In addition, the outer portion 54*c* of the trailing edge is shaped so as to advance in the rotational direction V of the blade 5 as travelling radially outward along the blade 5. Thus, air 61*a* and 61*b* flowing onto a suction face of the blade 5 gradually burbles due to the large slope of the outer portion 54*c* of the trailing edge, as illustrated, for example, on the axial fan 1 in FIG. 10. This can restrain concentration of the air 61*a* and 61*b* at the outer end B2 at the trailing edge. The air 61*a* and 61*b* flowing onto the blade 5 can be thereby smoothly blown along the ventilation channel 22 to the exhaust port 21*b*, as indicated by, for example, air 61*c*, 61*d*, and 61*e*. Thus, an increase in pressure is avoided that is ascribed to the air flowing along the suction face of the blade 5 to concentrate around the outer end B2 at the trailing edge. Hence, the generation of noise can be avoided.

In the axial fan 1, the intermediate portion 54*b* of the trailing edge 54 is positioned at 40 to 60% of the radial length of the blade 5. The intermediate portion 54*b* positioned in such a range can further restrain concentration of the air around the outer end B2 at the trailing edge of the blade 5. Thus, the generation of noise can be avoided.

In the axial fan 1, the trailing edge 54 has the inflection point 55 radially positioned at 60% to 90% of the blade 5. The inflection point 55 positioned in such a range can further restrain concentration of the air around the outer end B2 at the trailing edge of the blade 5. Thus, the generation of noise can be avoided.

In the axial fan 1, the peripheral length L2 of the outer peripheral edge 52 of the blade 5 in the air blowing direction W is shorter than the root length L1 of the blade root 51 in the air blowing direction W. This allows the air flowing in the peripheral direction along the suction face of the blade 5 to escape downwind in front of the trailing edge 54 of the blade 5 in the peripheral direction. Thus, an increase in pressure at the trailing edge 54 of the blade 5 can be restrained. Hence, the generation of noise can be avoided.

In the axial fan 1, a length of the chord line 58 connecting the trailing edge 54 and the leading edge 53 of the blade 5 is defined as the chord length. The largest camber is positioned in the section 59 at 40 to 60% of the chord length from the trailing edge 54. The largest camber positioned in such a range can further restrain concentration of the air around the outer end B2 at the trailing edge of the blade 5. Thus, the generation of noise can be avoided.

In the axial fan 1, the outer end B2 at the trailing edge 54 is positioned upstream of the midpoint 56 of the blade root 51 in the air blowing direction W. This allows the air flowing in the peripheral direction along the suction face of the blade 5 to escape downwind in front of the trailing edge 54 of the blade 5 in the peripheral direction. Thus, an increase in pressure at the trailing edge 54 of the blade 5 can be restrained. Hence, the generation of noise can be avoided.

Figure 11:
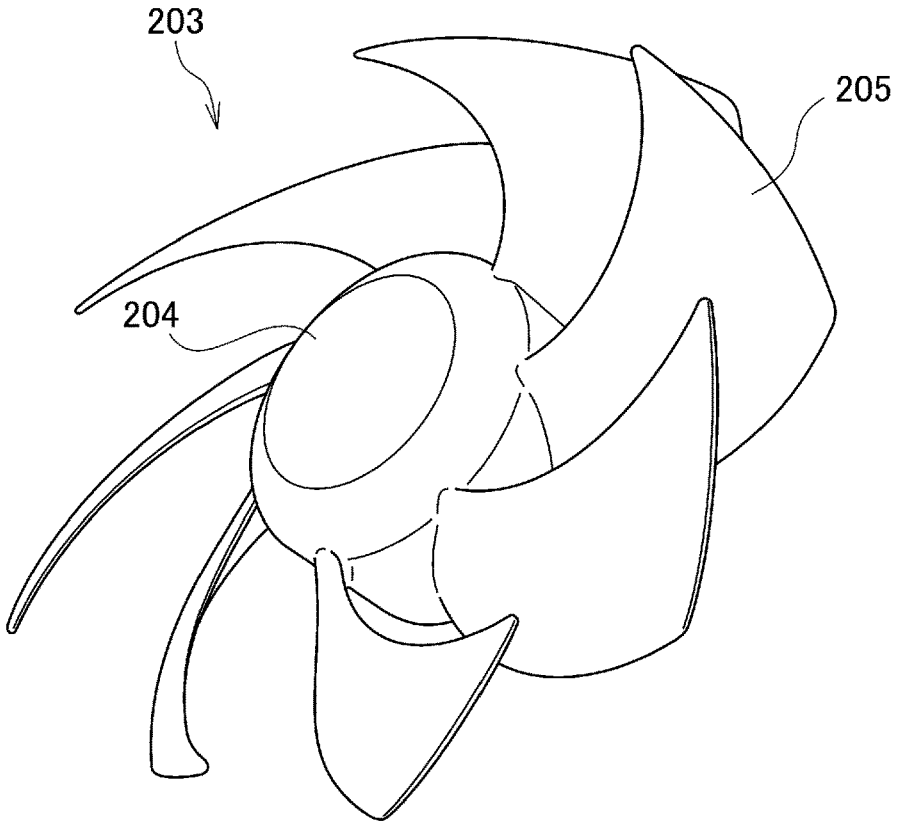
FIG. 11 is a perspective view of an impeller used in an axial fan according to a first comparative embodiment of the disclosure.
Figure 12:
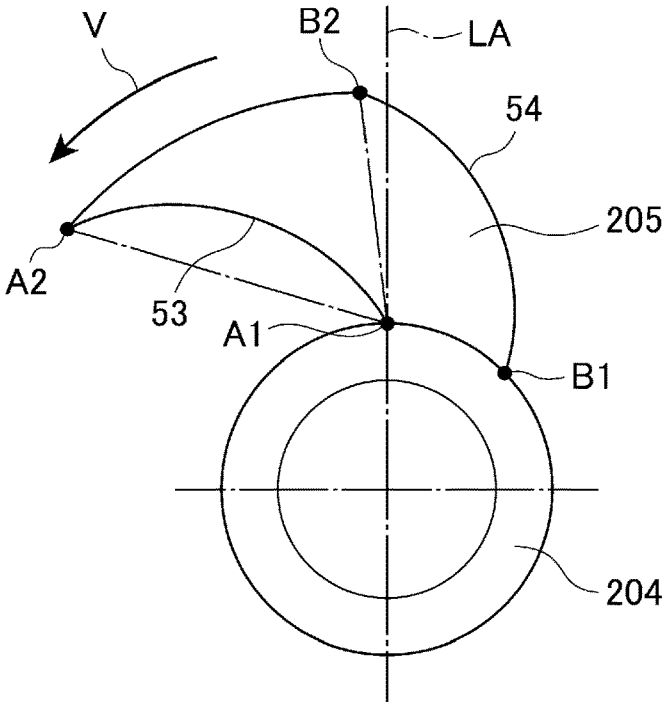
FIG. 12 is a top view of the impeller used in the axial fan according to the first comparative embodiment of the disclosure.

Results of tests will now be described that have been conducted to confirm effects of reduction of the noise by the axial fan 1 according to the present embodiment. FIG. 11 is a perspective view of an impeller 203 used in an axial fan according to a first comparative embodiment. FIG. 12 is a top view of the impeller 203 used in the axial fan according to the first comparative embodiment. The impeller 203 has the same features as the blade of the axial fan disclosed in Japanese Patent No. 4943817. For example, as illustrated in FIG. 12, the impeller 203 is configured such that an outer end B2 at a trailing edge 54 of a blade 205 is positioned further in a rotational direction V than a central line LA at the leading edge. In this regard, the impeller 203 is different from the impeller 3 of the axial fan 1 according to the present embodiment. In detail, the impeller 3 is configured such that the outer end B2 at the trailing edge 54 of the blade 5 is positioned behind the central line LA at the leading edge in the rotational direction V. A test was conducted for comparing the noise of the axial fan according to the first comparative embodiment with that of the axial fan 1 according to the present embodiment. It should be noted that, for example, the area of the blade of the impeller 203 and the angle for mounting the blade were adjusted such that the axial fan according to the first comparative embodiment had the performance (characteristics of air volume versus static pressure) equivalent to that of the axial fan 1 according to the present embodiment.

Figure 13:
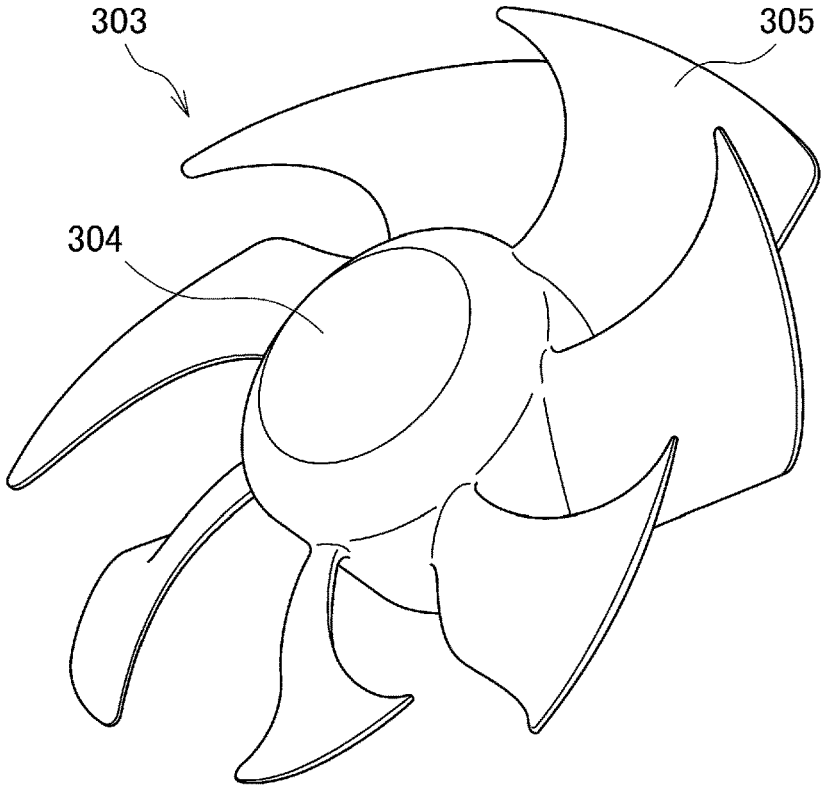
FIG. 13 is a perspective view of an impeller used in an axial fan according to a second comparative embodiment of the disclosure.
Figure 14:
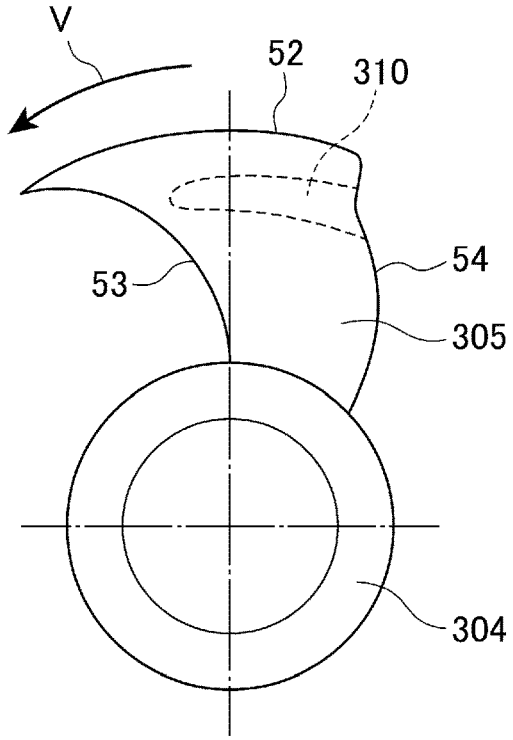
FIG. 14 is a top view of the impeller used in the axial fan according to the second comparative embodiment of the disclosure.

FIG. 13 is a perspective view of an impeller 303 used in an axial fan according to a second comparative embodiment. FIG. 14 is a top view of the impeller 303 used in the axial fan according to the second comparative embodiment. The impeller 303 has the same features as the blade of the axial blower disclosed in Japanese Patent No. 5210852. For example, as illustrated in FIG. 14, a reverse flection 310 is disposed in a region near an outer peripheral edge 52 of a blade 305. The reverse flection 310 is raised from the trailing edge 54 in the rotational direction V and recessed in the direction opposite to the rotational direction V. In addition, the reverse flection 310 extends along the outer peripheral edge 52 of the blade 305 to a leading edge 53 of the blade 305. In this regard, the impeller 303 is different from the impeller 3, which does not have the reverse flections 310, of the axial fan 1 according to the present embodiment. A test was conducted for comparing the noise of the axial blower according to the second comparative embodiment with that of the axial fan 1 according to the present embodiment. It should be noted that, for example, the area of the blade of the impeller 303 and the angle for mounting the blade were also adjusted such that the axial blower according to the second comparative embodiment had the performance equivalent to that of the axial fan 1 according to the present embodiment.

Figure 15:
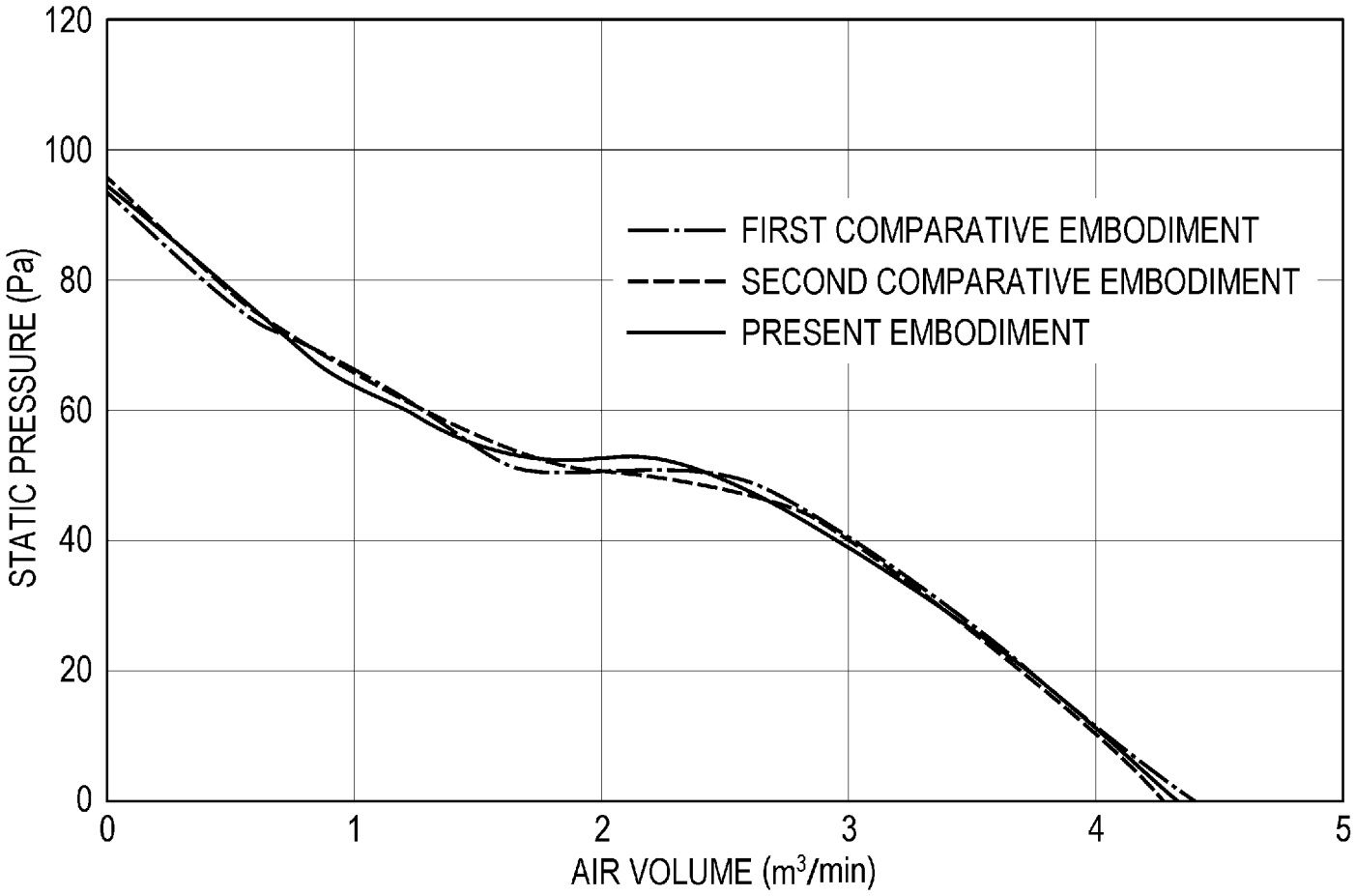
FIG. 15 is a graph indicating the characteristics of air volume versus static pressure of the axial fans according to the first and second comparative embodiments of the disclosure.

FIG. 15 is a graph indicating the characteristics of air volume versus static pressure of the axial fans according to the present embodiment, the first comparative embodiment, and the second comparative embodiment. For the axial fan 1 according to the present embodiment, the radial position of the intermediate portion 54*b* of the trailing edge 54 was set to 50% of the blade 5. The radial position of the inflection point 55 was set to 75% of the blade 5. In addition, the position of the largest camber was set to 50% of the chord length in the rotational direction V of the blade 5. The rotational speed of each axial fan was set to 3100 rpm. As illustrated in FIG. 15, the axial fans according to the present embodiment, the first comparative embodiment, and the second comparative embodiment had equivalent characteristics of air volume versus static pressure.

Figure 16:
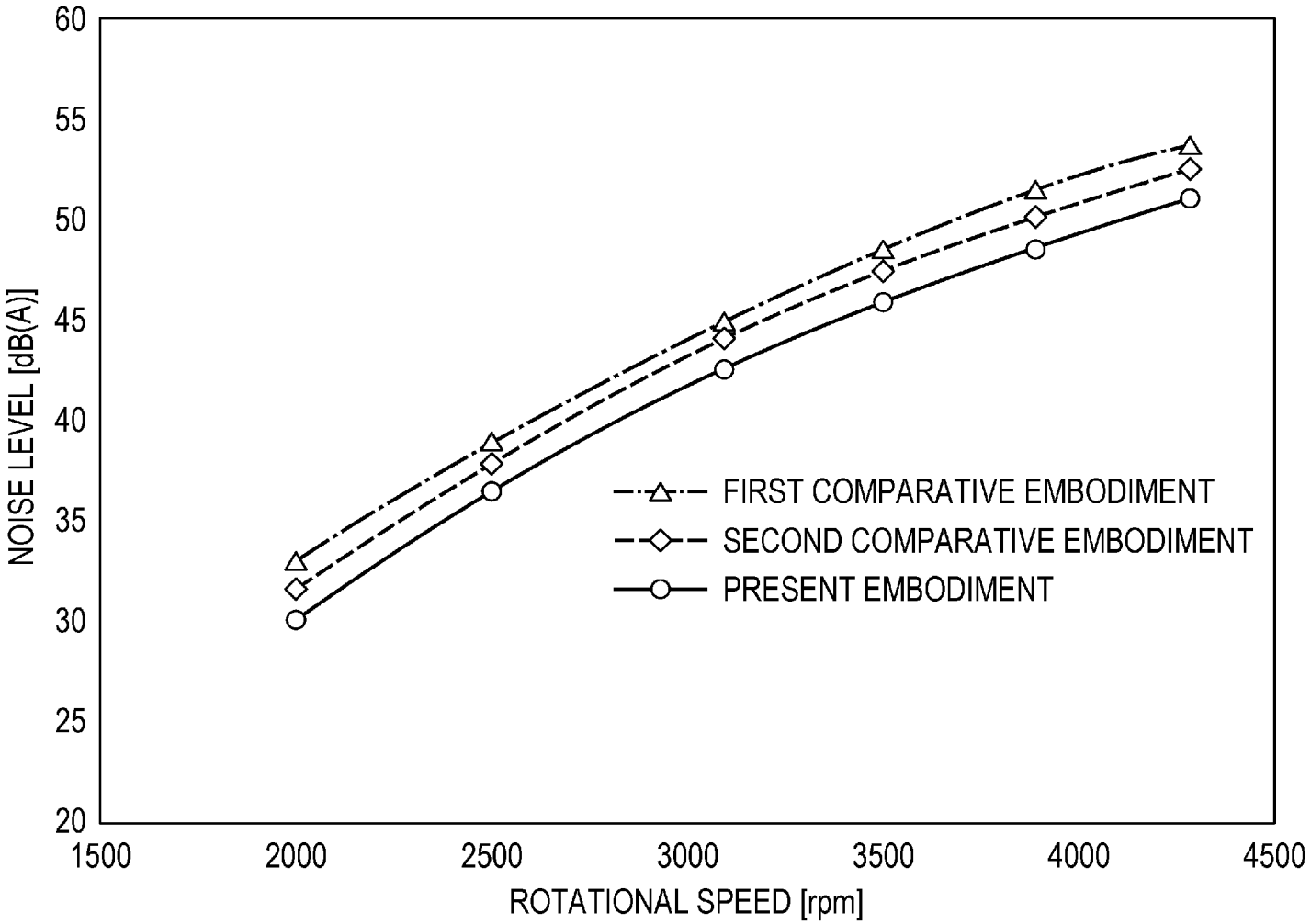
FIG. 16 is a graph indicating the rotational speed versus the noise level of the axial fans according to the first and second comparative embodiments of the disclosure.

FIG. 16 is a graph indicating the rotational speed versus the noise level of the axial fans according to the present embodiment, the first comparative embodiment, and the second comparative embodiment. As illustrated in FIG. 16, the axial fan 1 including the impeller 3 according to the present embodiment can reduce the noise to a level lower than that of the axial fan including the impeller 203 according to the first comparative embodiment or the axial fan including the impeller 303 according to the second comparative embodiment. For example, at a rotational speed of 3100 rpm, the axial fan according to the first comparative embodiment had a noise level of 46 dB(A) and the axial fan according to the second comparative embodiment had a noise level of 45 dB(A). In contrast, the axial fan 1 according to the present embodiment had a noise level of 43 dB(A).

The embodiment of the present disclosure has been described above. It should be noted, however, that the technical scope of the present embodiment is not to be interpreted by the foregoing description of the embodiment in a limiting manner. The aforementioned embodiment is a mere example. A person skilled in the art appreciates that various modifications can be made within the technical scope described in the appended claims. The technical scope of the present embodiment should be determined based on the technical scope of an embodiment recited in the claims and the equivalents thereof.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. An axial fan comprising:

multiple forward-swept blades, wherein an angle of advance of a trailing edge of the forward-swept blade is larger than an angle of advance of a leading edge of the forward-swept blade, and an outer portion of the trailing edge, being positioned further in an outer periphery of the trailing edge than an intermediate portion of the trailing edge with respect to a rotary shaft of the axial fan, advances as the trailing edge advances radially outward of a ventilation channel of the axial fan.

2. The axial fan according to claim 1, wherein the intermediate portion of the trailing edge is radially positioned at 40 to 60% of the forward-swept blade.

3. The axial fan according to claim 1, wherein the trailing edge has an inflection point radially positioned at 60 to 90% of the forward-swept blade.

4. The axial fan according to claim 1, wherein a largest camber is positioned at 40 to 60% of a chord length from the trailing edge in a sectional view of the forward-swept blade in a rotational direction, and the chord length is a length of a chord line connecting the trailing edge and the leading edge in the sectional view of the forward-swept blade in the rotational direction.

5. The axial fan according to claim 1, wherein in a sectional view of the axial fan in an air blowing direction, a length of an outer peripheral edge of the forward-swept blade in the air blowing direction is shorter than a length of a blade root of the forward-swept blade in the air blowing direction.

6. The axial fan according to claim 1, wherein in a sectional view of the axial fan in an air blowing direction, an outer end at the trailing edge is positioned upstream in the air blowing direction from a midpoint of a blade root of the forward-swept blade.

* * * * *